US006478687B1

(12) United States Patent
Colonello

(10) Patent No.: US 6,478,687 B1
(45) Date of Patent: Nov. 12, 2002

(54) GOLF CUP WITH BEARING INSERT

(75) Inventor: Alexander Colonello, Winnipeg (CA)

(73) Assignee: Bayco Golf Inc., Winnipeg (CA)

( * ) Notice: Subject to any disclaimer, the term of this patent is extended or adjusted under 35 U.S.C. 154(b) by 0 days.

(21) Appl. No.: 09/849,358

(22) Filed: May 7, 2001

(30) Foreign Application Priority Data

Jan. 8, 2001 (CA) ..... 2330379

(51) Int. Cl.[7] ..... A63B 57/00
(52) U.S. Cl. ..... 473/175; 473/176
(58) Field of Search ..... 473/175–179

(56) References Cited

U.S. PATENT DOCUMENTS

| | | | | |
|---|---|---|---|---|
| 1,329,732 A | | 2/1920 | Veritv | |
| 1,744,985 A | | 1/1930 | Picha | |
| 1,813,696 A | * | 7/1931 | Crocker | 473/176 |
| 1,943,610 A | * | 1/1934 | John | 473/176 |
| 3,511,501 A | | 5/1970 | Sandberg | |
| 4,114,879 A | | 9/1978 | Oiler | |
| 4,149,719 A | * | 4/1979 | Wakefield | 473/176 |
| 4,360,200 A | | 11/1982 | English | |
| 5,180,162 A | * | 1/1993 | Browne | 273/DIG. 24 |
| 5,351,950 A | * | 10/1994 | Frankum | 473/176 |
| 5,393,053 A | * | 2/1995 | Wiese et al. | 473/177 |
| 5,451,045 A | | 9/1995 | Garske | |
| 6,113,503 A | | 9/2000 | Brookman | |

* cited by examiner

*Primary Examiner*—Mark S. Graham
(74) *Attorney, Agent, or Firm*—Aikins, MacAulay & Thorvaldson; Murray E. Thrift

(57) ABSTRACT

A golf hole cup has a synthetic plastic cup component molded as a single, monolithic unit. This includes a cylindrical outer liner tube, a central ferrule support core tube and a mounting structure, including a cone support flanges supporting the core tube in the center of the liner tube. Molded into the cup component is a cylindrical metallic insert that forms the inner surface of the core tube to resist wear and damage from the ferrule of a flagstick. The insert is preferably formed from bearing bronze.

4 Claims, 2 Drawing Sheets

GOLF CUP WITH BEARING INSERT

FIELD OF THE INVENTION

The present invention relates to golf cups used for lining the holes in golf greens and supporting golf flagsticks therein.

BACKGROUND

The cups used in the holes in golf greens are conventionally manufactured of either injection moulded plastic or cast metal. It is also known to use a two-part cup with a tubular plastic outer hole liner and a metal stick holder fitted into the liner.

The plastic cups are known to wear out fairly rapidly because of the significant strength requirements and the inevitable wear and tear on the ferrule support. The metal cups are quite expensive as they are not only cast from metal but are coated with a wear-resistant powder coating process for the sake of appearance and resistance to the elements. Cups with large metal inserts, for example the insert disclosed in U.S. Pat. No. 4,360,200 to English are complex, multi-part structures.

The present invention is concerned with a novel form of golf cup and a method for its manufacture.

SUMMARY

According to one aspect of the present invention there is provided a golf hole cup comprising:

a synthetic plastic cup component including:
- a substantially cylindrical hole liner tube; and
- a stick ferrule support including:
  - a hollow core smaller than the hole liner tube; and
  - a core mount mounting the core in the center of the hole liner tube; and a wear resistant insert comprising a metallic sleeve mounted inside the core to engage and support a ferrule of a flag stick.

The metal insert in the core is set into the plastic cup to resist the wear and other physical damage caused by the repeated insertion and withdrawal of the stick ferrule, as well as the large and irregular loading that may be imposed on the flagstick by, for example, winds.

The insert is preferably manufactured from bronze of a quality used in bearings in order to provide the desired physical properties.

According to another aspect of the present invention there is provided a method of manufacturing a cup for a golf hole comprising:

providing an injection mould with a cavity including an annular outer cavity part, an cylindrical inner cavity part, and a connecting part extending between the inner and outer parts, the mould having a substantially cylindrical core to be positioned in the inner component of the cavity;

mounting an annular metallic sleeve on the core;

placing the core in the cavity;

injecting molten thermoplastic material into the cavity to fill the cavity;

allowing the thermoplastic material to solidify; and removing the moulded thermoplastic cup with the metallic sleeve insert from the injection mould.

The sleeve can thus be moulded directly into the cup using the same mould as that used for moulding all plastic cups. This allows either product to be manufactured using the same tooling.

BRIEF DESCRIPTION OF THE DRAWINGS

In the accompanying drawings, which illustrate an exemplary embodiment of the present invention.

DETAILED DESCRIPTION

Figure 2:
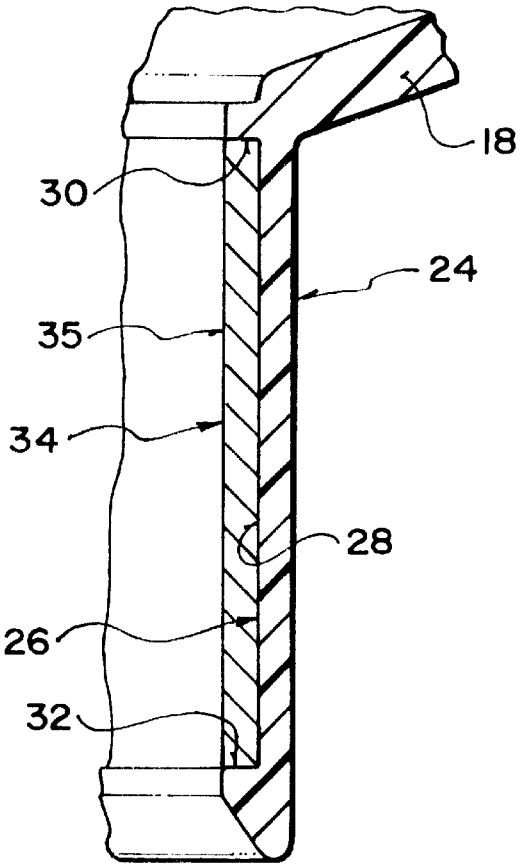
FIG. 2 is a cross sectional detail of the ferrule support of FIG. 1.
Figure 1:
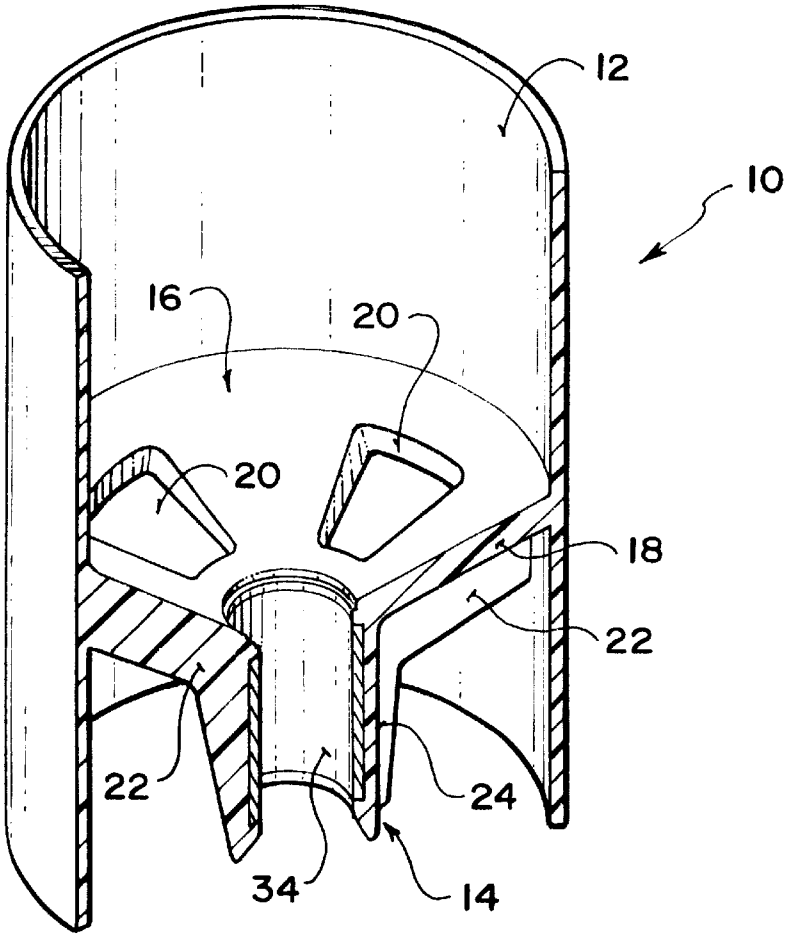
FIG. 1 is an isometric view of a cup according to the present invention, partially broken away.
Figure 3:
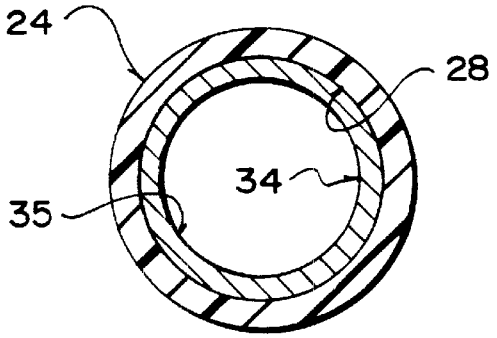
FIG. 3 is a transverse cross section of the ferrule support.
Figure 4:
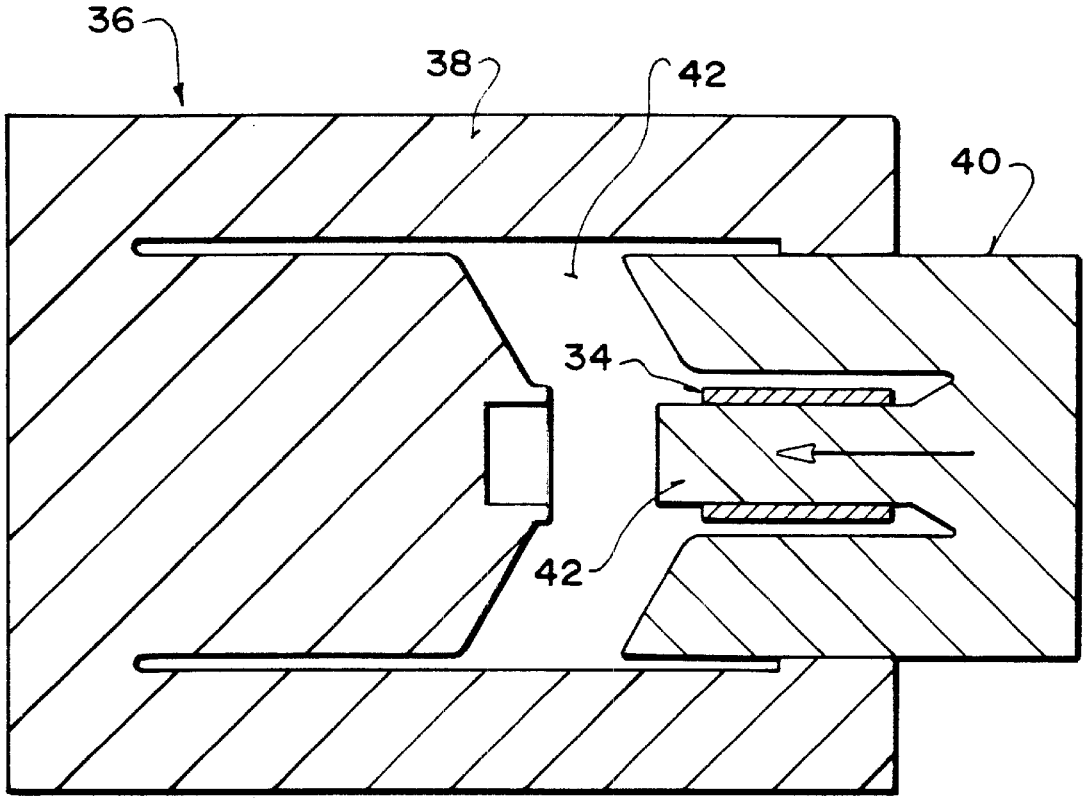
FIG. 4 is a schematic illustration of the method for manufacturing the cup.

Referring to the accompanying drawings, there is illustrated a golf cup 10 used in a hole in a golf green. The cup includes a hole liner tube 12. Centred on the liner tube is a ferrule support 14 for the ferrule on a flagstick. The ferrule support includes a mount component 16 including a downwardly convergent cone 18 with openings 20 spaced around the cone and a set of radial flanges 22 extending from the liner tube 12 along the underside of the cone to a core tube 24 depending from the centred cone. These components are all fabricated as a monolithic single moulding of thermoplastic material.

The core tube 24 has a central, annular recess 26. The recess is bounded by an annular outer face 28 and shoulders 30 and 32 on the top and bottom ends respectively. Set into the recess 26 is an insert 34. This is a cylinder of bearing bronze with a cylindrical inner face 35 flush with the inner, cylindrical faces of the shoulders 30 and 32.

The bronze insert 34 is substantially more resistant to wear from the repeated removal and insertion of the golf stick ferrule. It is also highly resistant to physical loads placed on the core tube of the ferrule support by such things as wind loading on the flagstick.

A cup as described above may be fabricated using a mould 36 that includes a mould body 38 and a core 40. When assembled these provide a cavity 42 that defines the shape of the complete golf cup.

To mould the cup with the insert 34, the insert is placed on the centre cylinder 42 of the mould core. The mould is then assembled and molten thermoplastic is injected into the cavity. When the cavity has been filled, the molten thermoplastic is allowed to solidify and then the completed part as described above is removed from the mould.

Where it is desired to manufacture the prior art cups of pure thermoplastic, the insert is not placed on the core cylinder 42 and the complete cavity, including the space otherwise occupied by the insert 34, is filled with thermoplastic material. In this way, the single mould can be used for the production of both types of product.

While one embodiment of the present invention has been described in the foregoing, it is to be understood that other embodiments are possible within the scope of the invention and are intended to be included herein. The invention is to be considered limited solely by the scope of the appended claims.

What is claimed is:

1. A golf hole cup comprising:

A a synthetic plastic cup component including:
- i) a substantially cylindrical hole liner tube; and
- ii) a stick ferrule support including:
  - (a) a hollow, substantially cylindrical core smaller than and concentric with the hole liner tube; and (b) a core mount mounting the core in the center of the hole liner tube; and B a wear resistant insert comprising a metallic sleeve mounted inside the core to engage and support a ferrule of a flag stick.

2. A cup according to claim 1 wherein the insert comprises a bronze sleeve.

3. A cup according to claim 1 wherein the hollow core comprises a sleeve with an annular recess in an inner surface thereof, the insert being set into the recess.

4. A cup according to claim 3 wherein the insert comprises a bronze sleeve.

* * * * *